US007068123B2

(12) United States Patent
Cayrou et al.

(10) Patent No.: US 7,068,123 B2
(45) Date of Patent: Jun. 27, 2006

(54) SINGLE-POLE DOUBLE-THROW SWITCH WITH NO SINGLE FAILURE POINT

(75) Inventors: Jean-Christophe Cayrou, Agen (FR); Régis Barbaste, Venerque (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/758,257

(22) Filed: Jan. 16, 2004

(65) Prior Publication Data

US 2004/0150492 A1 Aug. 5, 2004

(30) Foreign Application Priority Data

Jan. 17, 2003 (FR) ..... 03 00485

(51) Int. Cl.
*H01P 1/10* (2006.01)

(52) U.S. Cl. ..... 333/103; 333/262

(58) Field of Classification Search ..... 333/101, 333/103, 104, 262; 327/431
See application file for complete search history.

(56) References Cited

U.S. PATENT DOCUMENTS 4,810,911 A * 3/1989 Noguchi ..... 327/431
5,159,297 A * 10/1992 Tateno ..... 333/104
5,856,713 A * 1/1999 Huettner et al. ..... 307/125
5,872,491 A * 2/1999 Kim et al. ..... 333/101
5,990,580 A * 11/1999 Weigand ..... 307/125

FOREIGN PATENT DOCUMENTS

EP 1 237 222 A1 9/2002
EP 1 258 940 A 11/2002
FR 1 548 893 A 12/1968

* cited by examiner

*Primary Examiner*—Dean Takaoka
(74) *Attorney, Agent, or Firm*—Sughrue Mion, PLLC

(57) ABSTRACT

A single-pole double-throw switch comprises an input line portion and two output line portions connected to the input line portion at a branch point and defining with the input line portion two propagation channels for electromagnetic signals reaching the branch point via the input line portion. Each output line portion includes a two-state electronic component constituting either a substantially open circuit or a substantially short circuit as a function of the application of an appropriate command and being in one of these two states in the absence of a command. The two identical electronic components are each disposed in series in or in parallel with one of the two output line portions. The switch has an asymmetrical structure, the two propagation channels differing in their configuration and/or in the parity of their electrical length, expressed in quarter-wavelengths, between the components and the branch point, so that, regardless of the state of the components, one of the two channels is open and the other channel is closed.

6 Claims, 3 Drawing Sheets

CONFIGURATION 1

CONFIGURATION 2

SINGLE-POLE DOUBLE-THROW SWITCH WITH NO SINGLE FAILURE POINT

CROSS-REFERENCE TO RELATED APPLICATIONS

This application is based on French Patent Application No. 03 00 485 filed Jan. 17, 2003, the disclosure of which is hereby incorporated by reference thereto in its entirety, and the priority of which is hereby claimed under 35 U.S.C. §119.

BACKGROUND OF THE INVENTION

1. Field of the Invention

The field of the present invention is that of the transmission of electromagnetic signals, especially microwave signals, in particular the switching of such signals, and the present invention consists in a single-pole double-throw switch with no single failure point.

The present invention finds one application in signal processing systems having a structure in which functional modules are organized to obtain two for one redundancy.

2. Description of the Prior Art

Some types of equipment, especially equipment intended to be installed on board satellites, include functional modules that are duplicated so that a failure affecting the operation of one module can be remedied by starting up an identical or similar module that duplicates it in a parallel branch.

This kind of redundancy, known as two for one redundancy, is conventionally applied to diverse modules included in onboard equipment, for example amplifier modules for operating on signals that are transmitted via waveguides.

In cases of two for one redundancy of this kind, it is currently conventional to use a mechanical single-pole double-throw (SPDT) switch, for example a T switch, which remains in a previously assigned state in the absence of any command. It follows from this property that an appropriate command is necessary to change the state of the switch.

FIG. 1 shows an example of a mechanical switch of this kind which, in configuration 1 (FIG. 1A) allows the signal to propagate from the port 1 to the port 3 (port 2 being barred to the signal), after which, following an appropriate command or actuation (configuration 2—FIG. 1B), the switch allows the signal to propagate from port 1 to port 2 (port 3 being barred to the signal).

Because the mechanical switch remains in a given functional state in the absence of a command, it does not constitute a single failure point.

However, these mechanical switches are bulky and relatively heavy, and their use therefore represents a penalty in some applications, in particular in space applications.

To overcome these drawbacks and limitations, it has previously been proposed to replace mechanical switches with switching devices using electronic components.

However, in the absence of a command (energization current or voltage), because of the symmetry of the channels of the switch, an SPDT switch using solid state electronic components (diodes, transistors, etc.) is in an indeterminate and non-functional configuration.

To explain the problem arising from this situation more clearly, the operation of prior art electronic switches of this kind is explained below with reference to FIGS. 2 and 3 of the appended drawings, both in the case of a series configuration (FIG. 2) and in the case of a parallel configuration (FIG. 3).

In FIG. 2, the electrical distance between the points A and B, on the one hand, and the points A and C, on the other hand, is equal to an integer N multiple of half the wavelength $\lambda$ of the signal. The devices for switching from one channel to the other are disposed in series on each of the channels and the commands applied to the device of each channel are complementary. In theory, the switch operates as follows:

Case 1: a command sent to the device on channel 1-2 (1 to 2) causes the latter to behave like a short circuit. A complementary command sent to the device on channel 1-3 causes the latter then to behave as an open circuit. As seen from the branch at the point A, the channel 1-2 is adapted while the channel 1-3 is open circuit. Channel 1-2 is therefore open and channel 1-3 closed.

Case 2: this is complementary to case 1. Channel 1-3 is open and channel 1-2 is closed.

In FIG. 3, the electrical distance between the points A and B, on the one hand, and the points A and C, on the other hand, is equal to an odd integer $N_{odd}$ multiple of one quarter of the wavelength $\lambda$ of the signal. The devices for switching from one channel to the other are disposed in parallel on each channel. The commands applied to the devices of each channel are complementary. In theory, this switch operates as follows:

Case 1: a command sent to the device on channel 1-2 causes the latter to behave as a short circuit. The impedance as seen from the branch at the point A is an open circuit. A complementary command sent to the device on channel 1-3 causes the latter to behave as an open circuit. Being disposed in parallel, the latter is therefore transparent. As seen from the branch at the point A, channel 1-3 is adapted while channel 1-2 is open circuit. Channel 1-3 is therefore open and channel 1-2 is closed.

Case 2: this is complementary to case 1. Channel 1-2 is open and channel 1-3 is closed.

Note that, because of the symmetry of the switch, the commands applied to each channel must necessarily be complementary if the devices are identical (transistors of the same kind, diodes, etc.). Accordingly, if the commands do not reach one of the devices, and even more so if they fail to reach both devices, the channels behave neither as short circuits nor as open circuits. The signal then propagates simultaneously on both channels and is subject to at least the splitting losses, i.e. losses of 3 dB (there is half of the signal on each channel). If the switch is upstream of a receive head, these losses are unacceptable from a system point of view. The switch then constitutes a single failure point.

Switches in which the problem referred to above is present are described in U.S. Pat. Nos. 4,316,159, 4,779,065 and 5,696,470, for example, in relation to single, double or matrix switching arrangements, associated or not with two for one redundant systems.

To eliminate the switches or the like active switching devices as such, it has also been proposed to provide a waveguide in the form of a hollow tube adapted to transmit electromagnetic signals and in the wall of which are mounted two coupling probes (electromagnetic field sampling devices) that are connected to two duplicated functional branches of a two for one redundant system. A solution of this kind is disclosed in the document WO 01/82405, for example.

One or the other of the two branches of the system is selected by activating the first processing module of one of the two branches and adapting the impedance of that branch in a corresponding fashion to sample and transmit electromagnetic energy from signals propagating in the waveguide, the other branch having a reflective impedance (no transmission).

However, this solution necessitates the provision of a structure forming a waveguide and provided with two sampling probes (i.e. a precise mechanical assembly) and generally with additional impedance matching modules at the output of each probe, resulting in an overall structure that is bulky, complex and costly.

A particular object of the present invention is to overcome the drawbacks previously cited.

SUMMARY OF THE INVENTION

To this end, the present invention consists of a single-pole double-throw switch comprising an input line portion and two output line portions connected to the input line portion at a branch point and defining with the input line portion two propagation channels for electromagnetic signals reaching the branch point via the input line portion, wherein each output line portion includes a two-state electronic component constituting either a substantially open circuit or a substantially short circuit as a function of the application of an appropriate command and being in one of the two states in the absence of a command, and the two identical electronic components are each disposed in series or in parallel, with one of the two output line portions, wherein said switch has an asymmetrical structure, the two propagation channels differing in their configuration and/or in the parity of their electrical length, expressed in quarter-wavelengths, between the components and the branch point, so that, regardless of the state (i.e., said open circuit or said short circuit) of the components, one of the two channels always is open for electromagnetic signals and the other channel always is closed for electromagnetic signals.

The invention will be better understood in the light of the following description, which refers to preferred embodiments, provided by way of non-limiting example, and explained with reference to the appended diagrammatic drawings.

DETAILED DESCRIPTION OF THE PREFERRED EMBODIMENTS

Figure 1A:
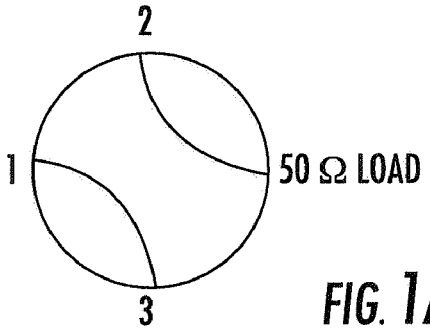
FIG. 1A PRIOR ART
FIG. 1 illustrates the prior art.
Figure 1B:
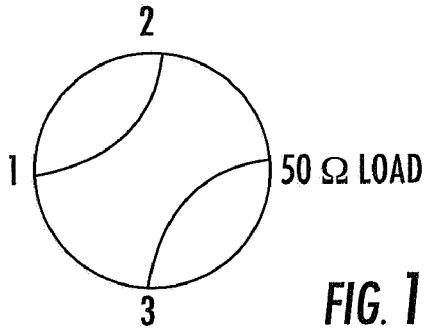
FIG. 1B PRIOR ART
Figure 2:
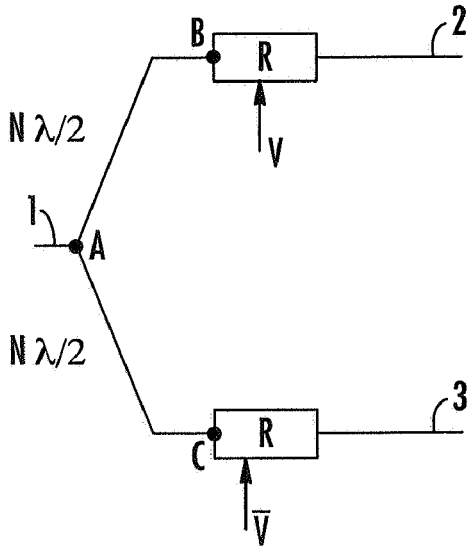
FIG. 2 PRIOR ART
FIG. 2 illustrates the prior art.
Figure 3:
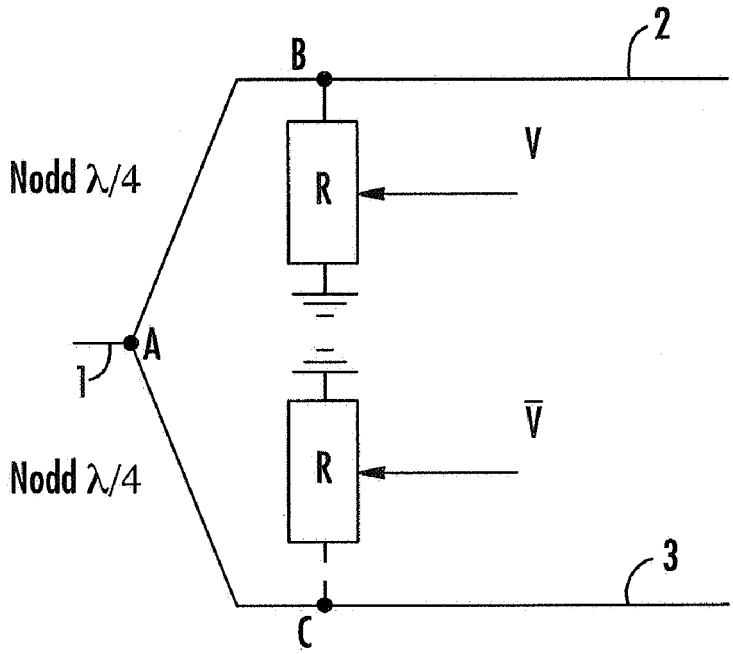
FIG. 3 PRIOR ART
FIG. 3 illustrates the prior art.
Figure 4:
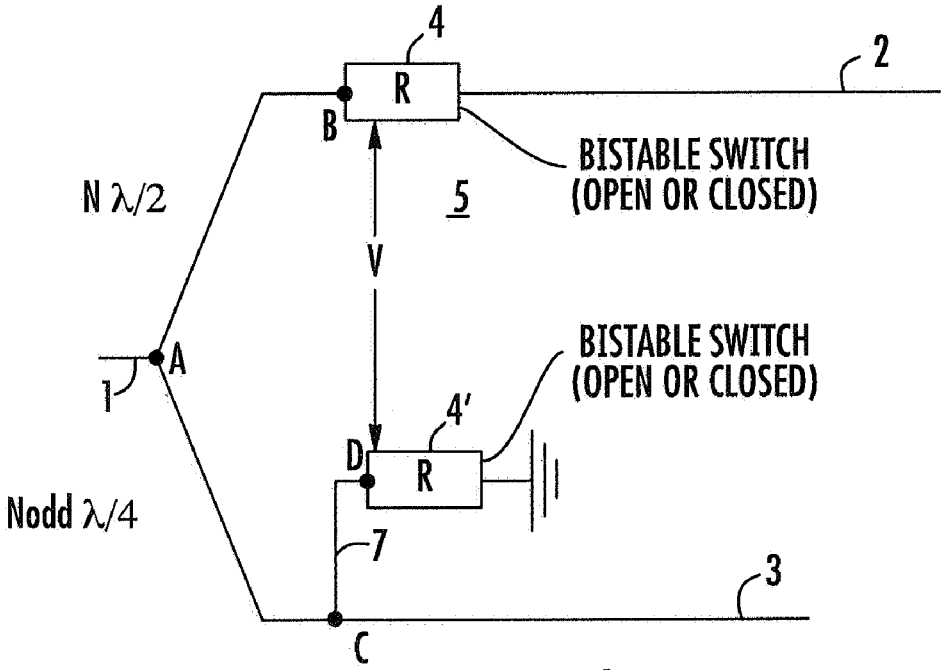
FIG. 4 is a functional representation of a first embodiment of a two channel to one channel switch of the invention.
Figure 5:
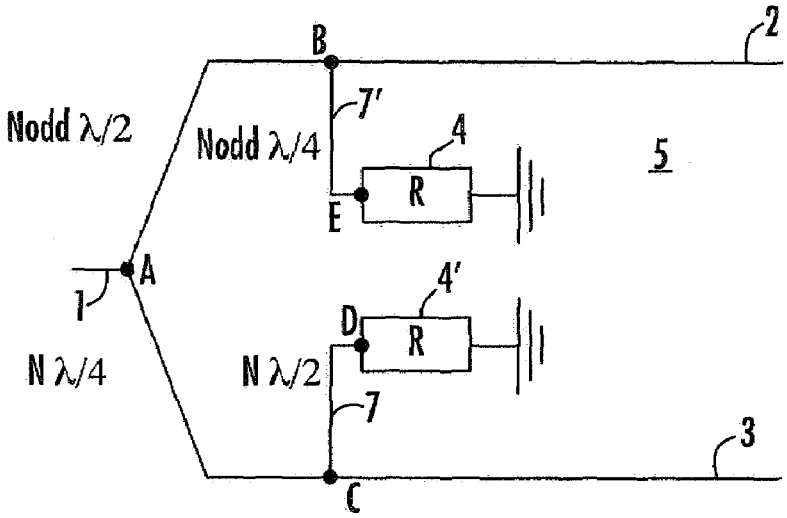
FIG. 5 is a functional representation of a second embodiment of the switch of the invention.

FIGS. 4 and 5 show a single-pole double-throw switch 5 comprising an input line portion 1 and two output line portions 2 and 3 connected to said input line portion 1 at a branch point A and defining with said input line portion 1 two propagation channels 1-2 and 1-3 for electrical signals reaching said branch point A via said input line portion 1. Each output line portion 2 and 3 comprises a two-state electronic component 4 and 4', forming either a substantially open circuit or a substantially short circuit as a function of the application of an appropriate command and being in one of the two states previously cited in the absence of a command, each of the two identical electronic components 4 and 4' being disposed in series in or in parallel with one of the two output line portions 2 and 3.

According to the invention, the switch 5 with no single failure point has an asymmetrical structure and the two propagation channels (1-2 and 1-3) differ in their configuration and/or the parity of their electrical lengths, expressed in quarter-wavelengths, between said components 4, 4' and the branch point A, so that, regardless of the common, same state of said components, one of the two channels for said electromagnetic signals is open and the other channel is closed.

Thus providing an asymmetrical switch 5 circumvents failure in the absence of a power supply or command at the electronic components 4 and 4' forming two-state (on/off) switches, said switch 5 not constituting a single failure point because of this.

In the absence of a command, the two identical electronic components 4 and 4' ideally form a short circuit (zero or virtually zero impedance) or an open circuit (high impedance), and are controlled by the same, common command V, which forces them simultaneously into one of the two states previously cited.

Because of the arrangement previously cited, different configurations of the two propagation channels (series or parallel connection of the components 4 and 4') and the provision of particular electrical lengths to the components 4 and 4' in each of the channels, it is possible to obtain systematically at the branch point A an adapted channel allowing transmission and a channel forming an open circuit and therefore blocking transmission.

In a first embodiment of the invention, and as shown in FIG. 4 of the appended drawings, one of the electronic components 4, 4' is disposed in series in one of the two output line portions 2, 3 and the other of said electronic components 4, 4' is disposed in parallel in the other of said output line portions 3, 2 and the following conditions are satisfied:

- $L_{AB}$ must be equal to an integer N multiple of a half-wavelength $\lambda/2$;
- $L_{AC}$ must be equal to an odd integer $N_{odd}$ multiple of a quarter-wavelength $\lambda/4$;
- $L_{CD}$ must be equal to an integer N multiple of a half-wavelength $\lambda/2$;
- C is the branch point between output line portion 3/shunt line portion 7 at level of the line portion 3 comprising said parallel component 4'; and
- B is the input point of series component 4;
- C is the branch point between output line portion 3/shunt line portion 7 at level of the line portion 3 comprising said parallel component 4; and
- D is the input point of said parallel component 4'.

In this case, if the electronic components 4 and 4' form a circuit or a switch that is open in the absence of the common, same command V, the component 4 of channel 1-2 has an infinite impedance (open circuit), in practice a very high impedance, and the impedance of channel 1-2, as seen from the branch A, is an open circuit.

The electronic component 4' on channel 1-3 is open circuit, but in a parallel configuration, with the result that it is invisible from point C. Channel 1-3 is therefore open and channel 1-2 is therefore closed.

In the event of a failure on channel 1-3, the components 4 and 4' are switched by an appropriate command to the short circuit state (very low impedance). Channel 1-2 is then open. On channel 1-3, the short circuit at point D causes a short circuit at point C and therefore an open circuit at point A (impedance inversion). Channel 1-3 is therefore closed.

In FIG. 4, when the electronic components 4 and 4' have a zero impedance (i.e. a short circuit) in the absence of a command, it follows from the foregoing description that channel 1-2 is naturally open and channel 1-3 is naturally closed.

In a second embodiment of the invention, shown in FIG. 5 of the appended drawings, the two components 4 and 4' are disposed in parallel on the two output line portions 2 and 3 and the following conditions are satisfied:

$L_{AB}$ must be equal to an odd integer multiple of a half-wavelength;

$L_{AC}$ must be equal to an odd integer multiple of a quarter-wavelength;

$L_{CD}$ must be equal to an integer multiple of a half-wavelength;

$L_{BE}$: odd integer multiple of a quarter-wavelength;

where:

A is the branch point between input line portion 1/output line portions 2, 3;

B and C are the branch points between respective output line portions 2, 3/shunt line portions 7, 7'; and E and D are the input points of the parallel components 4 and 4'.

Starting from the operation of the first embodiment described above, the person skilled in the art will understand that, regardless of the state (on/off) of the components 4 and 4' in the absence of a command, one of the channels 1-2 and 1-3 is naturally open or adapted and the other is naturally closed.

The electronic components 4 and 4' are preferably chosen in the group consisting of solid state components (diodes, transistors, microelectronic switches or the like) and micromachined components.

Figure 6:
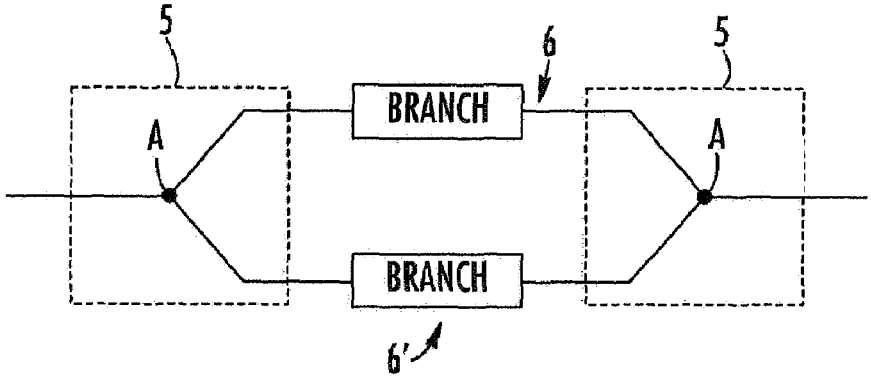
FIG. 6 is a simplified functional representation of a two for one redundant system comprising at least one switch of the invention.

The invention also consists in a two for one redundant structure system comprising two functionally identical parallel branches, as shown in FIG. 6.

This system is characterized in that selective transmission of the electromagnetic signals to one of the two branches 6 and 6' is effected by means of a switch device 5 as described hereinabove, each output line portion 2, 3 of said switch 5 being connected to the input of one of the two branches 6 and 6' of said system.

According to an additional feature of the invention, the outputs of the two branches 6 and 6' are connected to the output line portions 2 and 3 of a switch 5 of the type previously cited disposed in the opposite manner, to form a device for switching two channels to one channel.

In the present document, the term "line" must be understood as referring to any support able to transport electromagnetic signals and in particular as referring to lines in the form of conductive wires, ribbons, tracks, waveguides, etc.

Of course, the invention is not limited to the embodiments described and shown in the appended drawings, which may be modified without departing from the scope of protection of the invention, in particular from the point of view of the composition of the various components or by substitution of technical equivalents.

There is claimed:

1. A single-pole double-throw switch comprising an input line portion and two output line portions connected to said input line portion at a branch point and defining with said input line portion two propagation channels for electromagnetic signals reaching said branch point via said input line portion, wherein each output line portion includes an identical two-state electronic component constituting either a substantially open circuit or a substantially short circuit as a function of the application of an appropriate common, same command, said component being always in one of said two states in the absence of said common, same command, and wherein both said two identical electronic components are always simultaneously in a same one of said two states, and are disposed in series and in parallel with said two output line portions, respectively, said switch having an asymmetrical structure, said two propagation channels differing in their configuration and/or in the parity of their electrical length, expressed in quarter-wavelengths, between said components and said branch point, so that, regardless of said same state, said open circuit or said short circuit, of said components, one of said two channels always is open for electromagnetic signals and the other channel always is closed for electromagnetic signals, wherein one of said electronic components is disposed in series with one of said two output line portions, and the other of said electronic components is disposed in parallel with the other of said output line portions and the following conditions are satisfied:

$L_{AB}$ must be equal to an integer multiple of a half-wavelength;

$L_{AC}$ must be equal to an odd integer multiple of a quarter-wavelength;

$L_{CD}$ must be equal to an integer multiple of a half-wavelength;

where:

A is the branch point between input line portion/output line portions;

B is the input point of series component;

C is the branch point between output line portion/shunt line portion at level of the line portion comprising said parallel component; and;

D is the input point of said parallel component.

2. The switch claimed in claim 1, wherein said two components each constitute only an open circuit in the absence of said command.

3. The switch claimed in claim 1, wherein said two components each have only a zero or quasi zero impedance in the absence of a command.

4. The switch claimed in claim 1, wherein said electronic components are chosen from the group consisting of solid state components and micromachined components.

5. A two for one redundant structure system comprising two identical parallel functional branches, wherein electromagnetic signals are selectively transmitted to one of said two branches via a switch as claimed in claim 1 and each output line portion of said switch is connected to the input of one of said two branches of said system.

6. The system claimed in claim 5, wherein the outputs of said two branches are connected to said output line portions, oppositely connected, so as to form a device for switching two channels to one channel.

* * * * *